US005366311A

United States Patent [19]

Powers

[11] Patent Number: 5,366,311

[45] Date of Patent: Nov. 22, 1994

[54] COSMETIC PENCIL WITH DESCENDING SHEATH

[76] Inventor: Ronald J. Powers, 4010 Ischia Dr., Oxnard, Calif. 93035

[21] Appl. No.: 169,193

[22] Filed: Dec. 20, 1993

[51] Int. Cl.[5] ..... A45D 40/06; A45D 40/20

[52] U.S. Cl. ..... 401/194; 401/68; 401/75; 401/117; 401/173

[58] Field of Search ..... 401/173, 117, 68, 75, 401/76, 79, 194

[56] References Cited

U.S. PATENT DOCUMENTS

| | | | |
|---|---|---|---|
| 845,408 | 2/1907 | Gohl | 401/172 |
| 1,260,881 | 3/1918 | Doty | 401/79 |
| 4,595,124 | 6/1986 | Duval | 401/194 |

FOREIGN PATENT DOCUMENTS

| | | | |
|---|---|---|---|
| 648315 | 8/1928 | France | 401/173 |
| 868826 | 1/1942 | France | 401/172 |
| 2589696 | 5/1987 | France | 401/75 |
| 343658 | 6/1920 | Germany | 401/75 |

*Primary Examiner*—Steven A. Bratlie
*Attorney, Agent, or Firm*—Edgar W. Averill, Jr.

[57] ABSTRACT

A cosmetic pencil for dispensing a soft cosmetic mass. The cosmetic pencil has a hollow barrel which has an elongated push rod within it. A hollow sheath moves downwardly into the barrel. The push rod is grooved and the sheath has at least one tab which moves in and out of the push rod to provide a click or tactile feel as the cosmetic mass is dispensed. A sleeve within the sheath permits the cosmetic mass to be retracted into the sheath.

2 Claims, 2 Drawing Sheets

Fig. 1
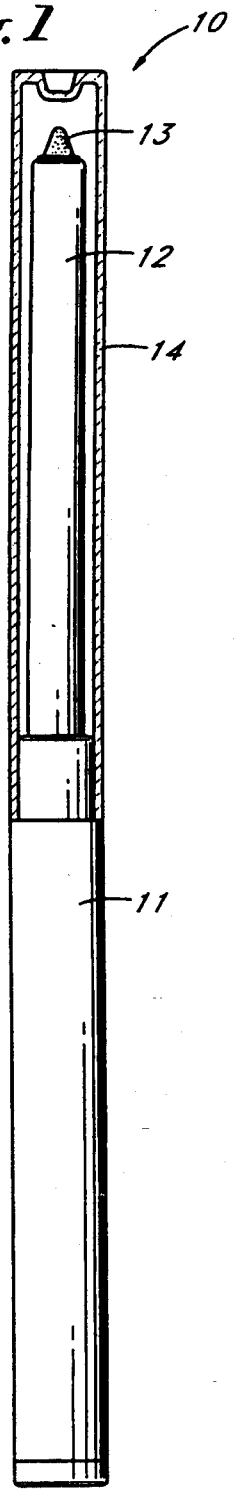
Fig. 2
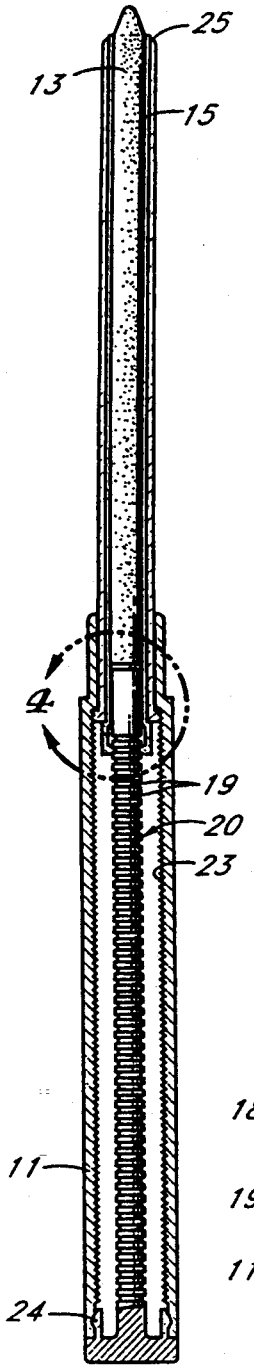
Fig. 3
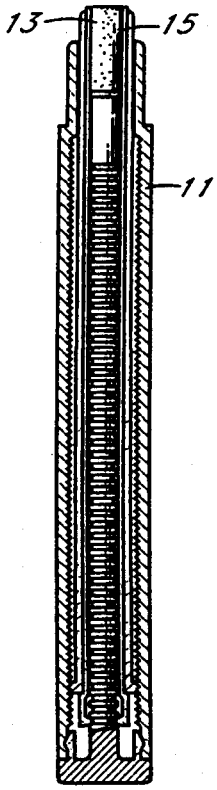
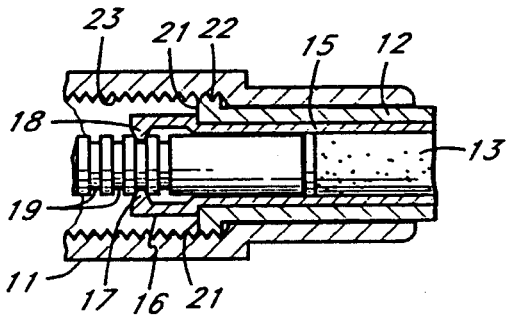
Fig. 4

COSMETIC PENCIL WITH DESCENDING SHEATH

BACKGROUND OF THE INVENTION

The field of the invention is cosmetic pencils and the invention relates more particularly to pencils capable of dispensing a relatively soft cosmetic mass such as an eyebrow pencil.

One such pencil is shown in applicants U.S. Pat. No. 4,696,594 which utilizes a gripping disk which urges a push rod 22 forward as the pencil is turned. While this device is very effective it does not give any indication of the amount of cosmetic mass left. Also it has a relatively large number of parts. Pencils for dispensing various types of crayons are shown in U.S. Pat. Nos. Re. 25741, 2,081,286, 2,274,311, 2,563,943, 3,219,044, 3,468,612, 3,768,915. A device which shows a descending sheath is shown in U.S. Pat. No. 3,514,211. It is important that the device dispense a very small amount of cosmetic mass s it is turned since only a small amount is used at any one time and if too much is extruded then it will simply break off and be wasted.

SUMMARY OF THE INVENTION

It is an object of the present invention to provide a cosmetic pencil for dispensing a soft cosmetic mass which permits the soft cosmetic mass to be retracted into the sheath. The present invention is for a cosmetic pencil for dispensing a soft cosmetic mass. The pencil has a generally elongated hollow barrel having a bottom, a top, an outer surface and an inner surface and the inner surface of the barrel is threaded. An elongated push rod is affixed at the bottom of the barrel and has grooves thereon. A hollow sheath holds a cosmetic mass within it and the elongated push rod fits snugly within the sheath. The bottom of the sheath is provided with threads which mate with the threaded inner surface of the barrel. As the sheath and barrel are moved with respect to one another the sheath moves downwardly into the barrel and the push rod pushes the cosmetic mass out of the top of the sheath. Preferably a sleeve is provided with tabs which movably secure it to the push rod and by turning the sheath and barrel in a counter clockwise direction the sleeve retains the cosmetic mass and the sheath extends over the end of the sleeve and the cosmetic mass thereby protecting it.

BRIEF DESCRIPTION OF THE DRAWINGS

FIG. 1 is a side view party in cross-section of the cosmetic pencil of the present invention.

FIG. 2 is a cross-sectional view of the cosmetic pencil of FIG. 1.

FIG. 3 is a cross-sectional side view of the cosmetic pencil of FIG. 1 with the sheath completely retracted.

FIG. 4 is an enlarged cross-sectional view taken along line 4—4 of FIG. 2.

DESCRIPTION OF THE PREFERRED EMBODIMENTS

Figure 5:
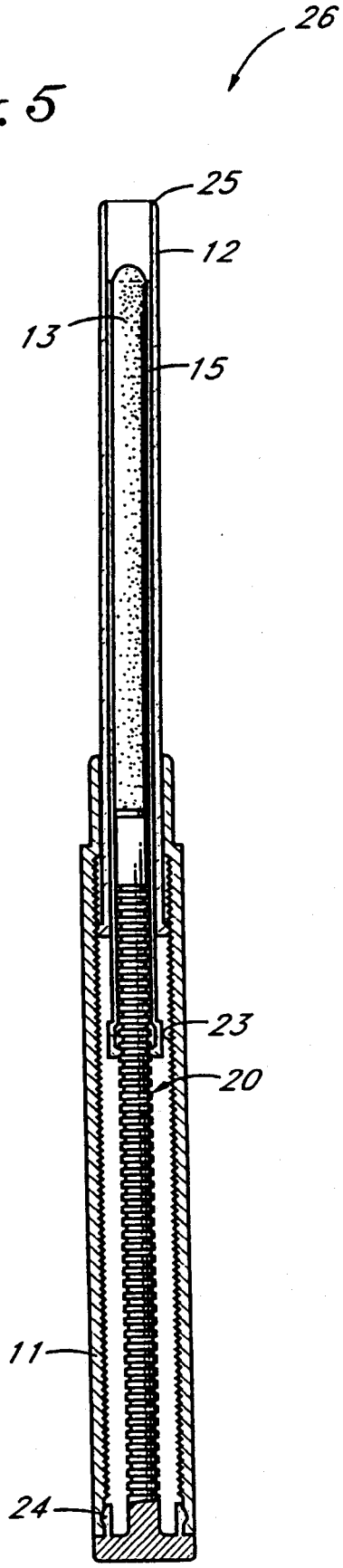
FIG. 5 is a cross-sectional view of the cosmetic pencil of FIG. 1 with the sleeve retracted.

The cosmetic pencil of the present invention is shown in side view and indicated generally by reference character 10. Cosmetic pencil 10 has a barrel 11, a sheath 12, a cosmetic mass 13, and a cap 14. Turning now to FIG. 2 it can be seen that a sleeve 15 is located within sheath 12. Sleeve 15 has an enlarged base 16 as shown in FIG. 4 which terminates in a pair of tabs 17 and 18. Tabs 17 and 18 pass in and out of a series of grooves 19 formed on push rod 20.

The enlarged base 16 of sleeve 15 abuts the bottom 21 of sheath 12. The bottom 21 of sheath 12 is also provided with external threads 22 which mate with internal threads 23 on the inner surface of barrel 11. Thus, as sheath 12 is turned with respect to barrel 11 sleeve 15 moves downwardly into barrel 11 and a clicking sound is formed when tabs 17 and 18 snap in and out of grooves 19 on push rod 20. Sleeve 15 is moved downwardly along push rod 20 by contact between the bottom 21 of sheath 12 and the enlarged base 16 of sleeve 15.

Push rod 20 is affixed at 24 to barrel 11 and as sheath 12 is turned in a clockwise direction with respect to barrel 11, sheath 12 and sleeve 15 move downwardly into barrel 11 thereby exposing cosmetic mass 13. This gives the user a visual reading of how much of the cosmetic mass has been used. The fully retracted sleeve is shown in FIG. 3.

An important feature of the present invention is the ability of the cosmetic mass 13 to be withdrawn beneath the outer edge 25 of sheath 12 by turning the sheath 12 counter clockwise with respect to barrel 11. The sheath is moved outwardly. Sleeve 15 is retained by the contact between the tabs 17 and 18 and grooves 19 in push rod 20. Also sleeve 15 is formed from a polymer having a relatively high degree of slip. In use the retracted pencil 26 of FIG. 5 is placed again in a useable position by the clockwise rotation of barrel 11 with respect to sheath 12. This moves sleeve 15 outwardly until the enlarged base 16 of sleeve 15 abuts bottom 21 of sheath 12, thereby permitting additional cosmetic mass to be extruded if necessary.

Figure 6:
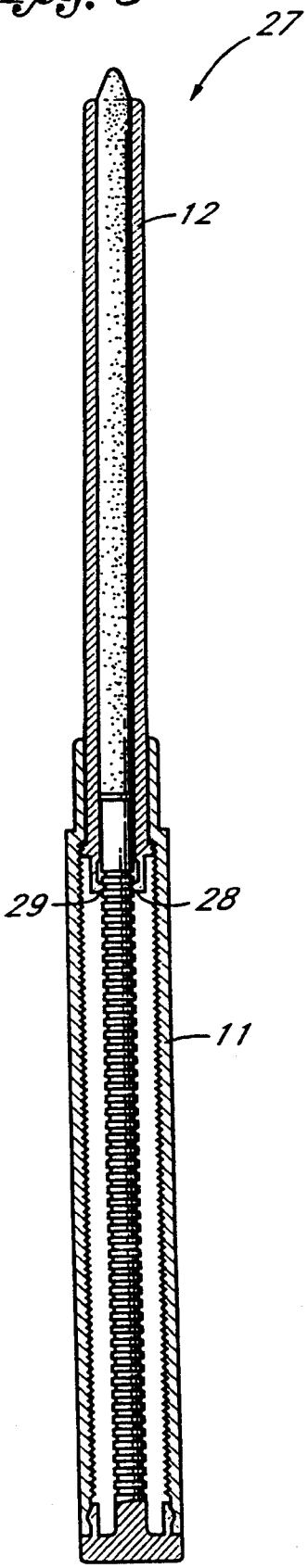
FIG. 6 is an alternate embodiment of the cosmetic pencil of FIG. 1.

While sleeve 15 permits the retraction of the cosmetic mass it is not essential for the operation of the cosmetic pencil and a cosmetic pencil 27 without sleeve 15 is shown in FIG. 6 and indicated by reference character 27. The barrel 11 and sheath 12 is identical except that tabs 28 and 29 are formed on the bottom of sheath 12 instead of on the sleeve. This still provides a tactile indication as sheath 12 is threaded into barrel 11.

The cosmetic pencil of the present invention provides a smooth and gradual extension of the cosmetic mass and also provides a visual indication of the amount of cosmetic mass used. Most importantly, it can be provided with a means for retracting the cosmetic mass within the sheath so it will not be inadvertently contacted with cap 14.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A cosmetic pencil for dispensing a soft cosmetic mass, said cosmetic pencil comprising:

a generally cylindrical elongated hollow barrel having a bottom, a top, an outer surface and an inner surface, said inner surface being threaded;

an elongated push rod having a bottom and a top and being affixed at the bottom to the bottom of the barrel;

a hollow sheath having a bottom, a top, an outer surface and an inner surface, said sheath having a threaded portion on its outer surface at the bottom thereof which mates with the threaded inner surface of the barrel, and said sheath being at least partially filled with a cosmetic mass, whereby when said push rod and sheath are turned with respect to each other, the sheath moves downwardly into the barrel and the push rod extends into the sheath and pushes the cosmetic mass out of the top end of the sheath, and wherein the push rod has peripheral grooves and the sheath has at least one tab which moves in and out of the grooves on the push rod as the sheath moves downwardly on said push rod to provide a tactile indication of inward movement of the sheath into the barrel.

2. A cosmetic pencil for dispensing a soft cosmetic mass, said cosmetic pencil comprising:

a generally cylindrical, elongated hollow barrel having a bottom, a top, an outer surface and an inner surface, said inner surface being threaded;

an elongated push rod having a bottom and a top and being affixed at the bottom to the bottom of the barrel, said push rod having peripheral grooves along its length;

a hollow sheath having a bottom, a top, an outer surface and an inner surface, said sheath having a threaded portion on its outer surface at the bottom thereof which meets with the threaded inner surface of the barrel, and said sheath being at least partially filled with cosmetic mass;

a hollow sleeve positioned against the inner surface of said sheath between the cosmetic mass and the sheath, said sleeve having a top and a bottom and a bottom ring which abuts the bottom of said sheath and said sleeve has at least one tab which passes in and out of the grooves of said push rod when the push rod moves into said sheath whereby when said push rod and sheath are turned with respect to each other, the sheath and the sleeve move downwardly into the barrel and the push rod extends into the sheath and pushes the cosmetic mass out of the top of the sheath and the tab passes in and out of the grooves to provide a tactile feel as the sheath and sleeve descend into the barrel.

* * * * *